US012404738B2

(12) United States Patent
Rusten et al.

(10) Patent No.: US 12,404,738 B2
(45) Date of Patent: Sep. 2, 2025

(54) DOWNHOLE PRESSURE EQUALIZER

(71) Applicant: Interwell P&A AS, Hafrsfjord (NO)

(72) Inventors: Torgeir Rusten, Vikhammer (NO); Gaute Sandvik, Saksvik (NO)

(73) Assignee: INTERWELL P&A AS, Røyneberg (NO)

( * ) Notice: Subject to any disclaimer, the term of this patent is extended or adjusted under 35 U.S.C. 154(b) by 0 days.

(21) Appl. No.: 18/281,016

(22) PCT Filed: May 5, 2022

(86) PCT No.: PCT/EP2022/062176
§ 371 (c)(1),
(2) Date: Sep. 8, 2023

(87) PCT Pub. No.: WO2022/243056
PCT Pub. Date: Nov. 24, 2022

(65) Prior Publication Data

US 2024/0141753 A1 May 2, 2024

(30) Foreign Application Priority Data

May 21, 2021 (NO) ..... 20210637

(51) Int. Cl.
*E21B 33/13* (2006.01)
*E21B 23/04* (2006.01)
(Continued)

(52) U.S. Cl.
CPC ..... *E21B 33/13* (2013.01); *E21B 23/0412* (2020.05); *E21B 23/0414* (2020.05);
(Continued)

(58) Field of Classification Search
CPC ..... E21B 23/0412; E21B 23/0414; E21B 23/042; E21B 29/02; E21B 33/13; E21B 33/134; E21B 36/008
See application file for complete search history.

(56) References Cited

U.S. PATENT DOCUMENTS

2012/0255742 A1 10/2012 Cortez
2013/0205888 A1* 8/2013 Teowee ..... F42D 5/02 102/210

(Continued)

FOREIGN PATENT DOCUMENTS

| | | |
|---|---|---|
| NO | 20190537 | 10/2020 |
| WO | 2015/023807 | 2/2015 |
| WO | 2019/151870 | 8/2019 |

OTHER PUBLICATIONS

International Search Report issued Aug. 18, 2022 in International (PCT) Application No. PCT/EP2022/062176.

(Continued)

*Primary Examiner* — Nicole Coy
*Assistant Examiner* — Jennifer A Railey
(74) *Attorney, Agent, or Firm* — Wenderoth, Lind & Ponack, L.L.P.

(57) ABSTRACT

The present invention relates to a downhole pressure equalizer comprising an elongated housing comprising a piston compartment having a first end provided in fluid communication with an outside of the elongated housing and a second end provided in fluid communication with a process chamber of a well tool. A piston device provided in the position compartment comprises an outer piston section slidingly and sealingly engaged with the piston compartment; and an inner piston section slidingly and sealingly engaged within the through bore of the outer piston section.

14 Claims, 7 Drawing Sheets

(51) Int. Cl.
*E21B 29/02* (2006.01)
*E21B 36/00* (2006.01)

(52) U.S. Cl.
CPC ..... *E21B 23/042* (2020.05); *E21B 29/02* (2013.01); *E21B 36/008* (2013.01)

(56) References Cited

U.S. PATENT DOCUMENTS

| | | | | |
|---|---|---|---|---|
| 2014/0014352 | A1* | 1/2014 | Hallundbæk ..... | E21B 43/1195 166/320 |
| 2018/0058154 | A1* | 3/2018 | Kitchen ..... | E21B 23/00 |
| 2018/0148991 | A1* | 5/2018 | Hearn ..... | H01L 25/50 |
| 2019/0178049 | A1 | 6/2019 | Kræmer | |

OTHER PUBLICATIONS

Search Report issued Dec. 21, 2021 in Norwegian Application No. 20210637.

* cited by examiner

DOWNHOLE PRESSURE EQUALIZER

FIELD OF THE INVENTION

The present invention relates to a downhole pressure equalizer for equalizing the pressure inside a well tool with the well pressure outside the well tool.

BACKGROUND OF THE INVENTION

A pyrotechnic mixture typically comprises particulate matter, in which voids may be present. When a well tool device having a housing with a compartment containing the pyrotechnic mixture is lowered into the well, there will be a pressure difference between the well pressure outside the housing and the pressure inside the compartment of the housing. As the pyrotechnic mixture will melt the housing, there will be a sudden pressure equalization between the outside the housing and the compartment, which may impact the heat generation process negatively. In some cases, the heat generating process may stop due to such a sudden equalization.

WO2013/135583 (Interwell P&A AS), it is disclosed method for performing a P&A operation wherein a first step, it was provided an amount of a pyrotechnic mixture (for example thermite) at a desired location in the well and thereafter to ignite the pyrotechnic mixture to start a heat generation process. It is also disclosed a tool for transporting the pyrotechnic mixture into the well before ignition.

The transportation tool must store and protect its content until it has reached the intended position in the well. It is therefore of key importance that the tool can withstand the increasing ambient pressure exerted on it as it is lowered into the well. In the event of a collapse, the content of the tool will likely be destroyed and lost. A collapsed tool can also be difficult if not impossible to install in the well. To withstand external pressure, tools are typically made of expensive high strength materials or their wall thickness is increased which require more material which in turn increase cost.

NO 20190537 describes a well tool device and a method for forming a permanent well barrier. The well tool device comprises: a housing; a movable partition device provided within the housing, the partition device separating an inner volume of the housing in a first volume defining a first compartment and a second volume defining a second compartment. A pyrotechnic mixture is provided in the first compartment; and a fluid line providing fluid communication between the second compartment and an outside of the housing. While running the well tool device into the well, the pressure difference between a pressure inside the first compartment and a pressure inside the second compartment is equalized by means of the partition device being affected by the pressure inside the second compartment.

When the heat generating process is initiated, heat and gas will be produced as part of the process. This will cause the pressure inside the compartment to increase again.

One object of the present invention is to improve the heat generating process.

SUMMARY OF THE INVENTION

The present invention relates to a downhole pressure equalizer comprising:

an elongated housing comprising a piston compartment having a first end provided in fluid communication with an outside of the elongated housing and a second end provided in fluid communication with a process chamber of a well tool;

a piston device slidingly and sealingly engaged within the piston compartment, wherein the piston device is separating the piston compartment into a first sub-compartment between the piston device and the first end and a second compartment between the piston device and the second end;

wherein the piston device comprises:

an outer piston section slidingly and sealingly engaged with the piston compartment; wherein the outer piston section comprises a sleeve having a through bore;

an inner piston section slidingly and sealingly engaged within the through bore of the outer piston section;

wherein the downhole pressure equalizer is configured to be in one of the following states:

a first state, in which the pressure difference between the fluid pressure in the first sub-compartment and the fluid pressure in the second sub-compartment causes the outer piston section and the inner piston section to move towards the second end of the piston compartment;

a second state, in which the pressure difference between the fluid pressure in the first sub-compartment and the fluid pressure in the second sub-compartment causes the inner piston section to move towards the first end of the piston compartment while the outer piston section is kept stationary.

In the first state, as the outer piston section and the inner piston section are moving towards the second end of the piston compartment, the pressure difference between the pressure in the first sub-compartment and the pressure in the second sub-compartment will be reduced.

Also in the second state, as the inner piston section is moving towards the first end of the piston compartment, the pressure difference between the pressure in the first sub-compartment and the pressure in the second sub-compartment will be reduced.

In the first state, the pressure difference is positive, i.e. the fluid pressure in the first sub-compartment is higher than the fluid pressure in the second sub-compartment.

In the second state, the pressure difference is negative, i.e. the fluid pressure in the first sub-compartment is lower than the fluid pressure in the second sub-compartment.

In one aspect, the downhole pressure equalizer is configured to be in one of the following states:

an initial state, in which the outer piston section and the inner piston section are located in the first end of the piston compartment and wherein the second piston compartment is pressurized with a predetermined fluid pressure.

The predetermined fluid pressure is typically determined based on the expected well pressure at the well depth at which the downhole pressure equalizer and the well tool is to be used.

In one aspect, the downhole pressure equalizer is configured to be in one of the following states:

a final state, in which the inner piston section has slid out of its sealing engagement with the through bore of the outer piston section.

In the final state, the piston device is no longer considered to be a piston, as there is a direct fluid communication between the first sub-compartment and the second sub-compartment.

In one aspect, the downhole pressure equalizer comprises a longitudinal communication bore for sensing the pressure in the second sub-compartment at a location adjacent to the first end of the housing.

In one aspect, the longitudinal communication bore is a fluid line, wherein a sensor for sensing the pressure in the second sub-compartment is located in the bore adjacent to the first end of the housing.

In one aspect, the downhole pressure equalizer comprises:

a longitudinal rod provided through the piston compartment and secured at both ends to the housing;

wherein the outer piston section is slidingly and sealingly engaged with the outer surface of the rod; and wherein the inner piston section is slidingly and sealingly engaged with the outer surface of the rod.

In one aspect, the longitudinal rod is provided centrally through the piston compartment.

In one aspect, the longitudinal communication bore is provided within the rod.

In one aspect, a first friction parameter representing a friction for moving the outer piston section relative to the housing is larger than a second friction parameter representing a friction for moving the inner piston section relative to the outer piston section.

In one aspect, the first friction parameter and the second friction parameter are defined by the number of, and/or the properties, of sealing elements sealingly engaged between the piston device and the piston compartment and between the inner piston section and the outer piston section.

In one aspect, the outer piston section comprises a sleeve in which the bore is provided, wherein the sleeve comprises a stop preventing relative movement between the inner piston section and the sleeve when the downhole pressure equalizer is in the first state.

In one aspect, the inner piston section comprises a first end section, a second end section and an intermediate section, wherein the second end section is sealingly engaged within the bore of the outer piston section and where a first surface of the second end section is faced towards the first piston compartment and wherein a second surface of the second end section is faced towards the second piston compartment.

In one aspect, the first end section of the inner piston section comprises a collar protruding from the bore wherein the collar is slidingly engaged with the piston compartment.

Hence, in the second state, the second end section of the inner piston section is sliding along the bore while the first end section of the inner piston section is sliding along the piston compartment.

The present invention also relates to a well tool assembly for forming a permanent barrier in a well, wherein the well tool assembly comprises:

a plugging and abandonment tool comprising a housing, a chamber within the housing, and a heat generating mixture and an igniter located within the chamber;

a downhole equalizing tool according to any one of the above claims connected above the plugging and abandonment tool, wherein the second sub-compartment is provided in fluid communication with the chamber of the plugging and abandonment tool.

In one aspect, the well tool assembly comprises:

a control and logging system connected above the downhole equalizing tool, wherein the control and logging system comprises:

a first pressure sensor for logging a parameter representative of a first pressure in the first sub-compartment;

a second pressure sensor for logging a parameter representative of a second pressure in the second sub-compartment;

wherein control and logging system is configured to verify that the first pressure is equalized with the second pressure when the well tool assembly has been lowered to the desired location in the well and before the heat generation mixture is ignited by the igniter.

In one aspect, the control and logging system is configured to verify that the first pressure is equalized with the second pressure after the heat generation process has finished.

In one aspect, the first pressure equals the pressure in the well.

According to invention above, it is achieved that the pressure difference between the well pressure and the internal compartment pressure is equalized before the heat generating process starts. In addition, it is achieved that the pressure difference between the well pressure and the internal compartment pressure is equalized in the initial phase of the heat generating process and further throughout the heat generating process.

The term "upper", "above", "lower", "below" etc. are used herein as terms relative to the well. Parts referred to as "upper" or "above" are relatively closer to the top of the well than the parts referred to as "lower" or "below", which are relatively closer to the bottom of the well, irrespective of the well being a horizontal well, a vertical well or an inclining well.

DETAILED DESCRIPTION

Embodiments of the invention will now be described with reference to the enclosed drawings, wherein.

Figure 5:
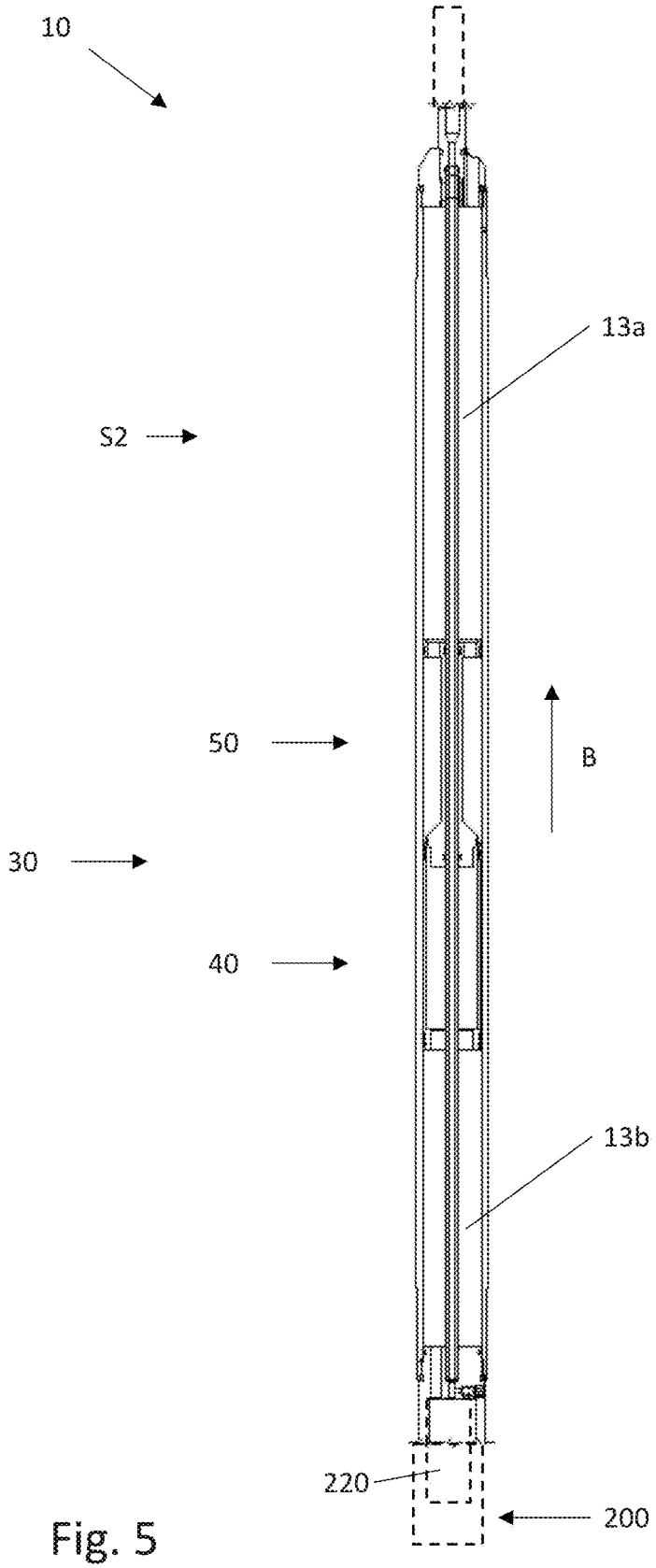
Figure 6A:
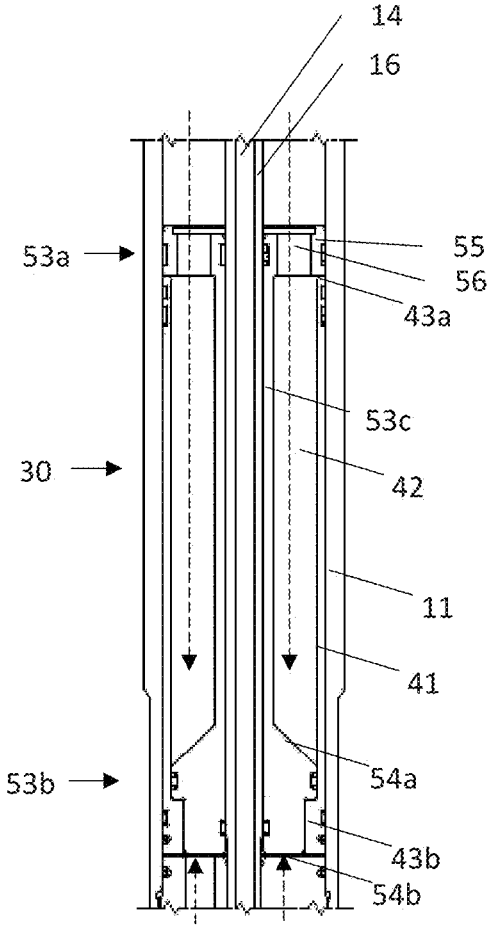
Figure 6B:
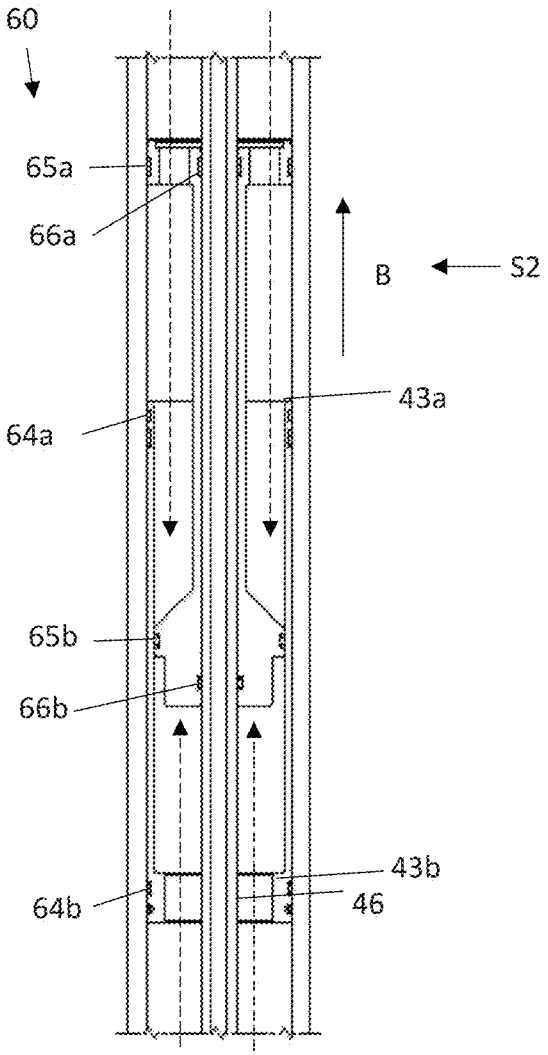
Figure 6C:
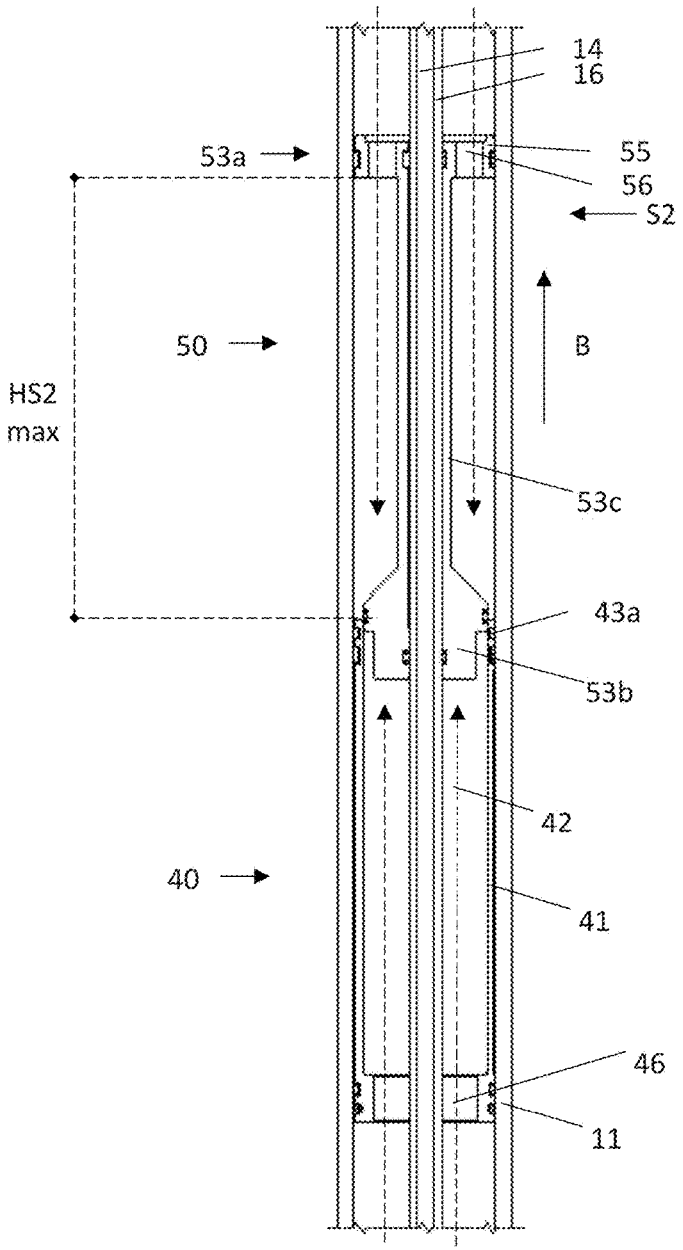
Figure 6D:
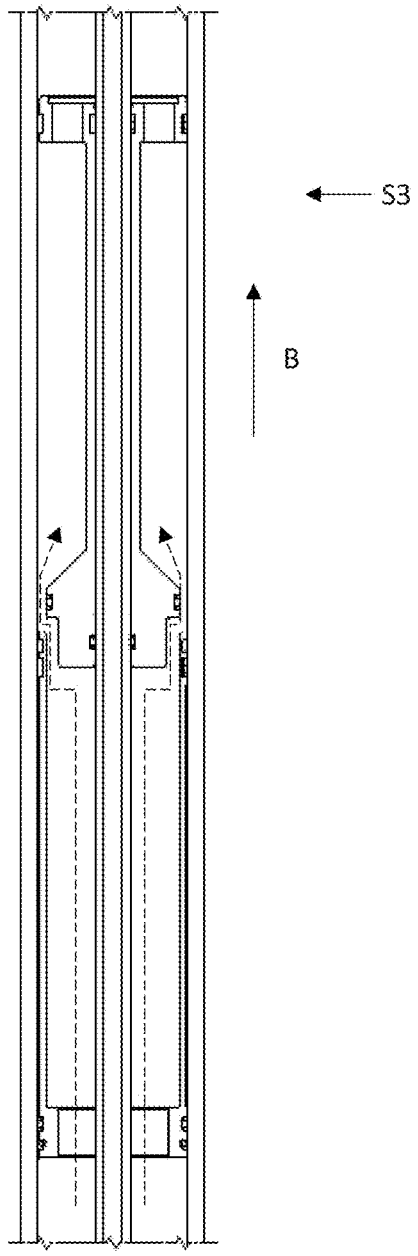

FIG. 5 also illustrates the equalizing tool in the second state;

FIG. 6*a* illustrates an enlarged view of the piston in the initial and first states;

FIG. 6*b* illustrates an enlarged view of the piston in the start of the second state;

FIG. 6*c* illustrates an enlarged view of the piston in the end of the second state;

FIG. 6*d* illustrates an enlarged view of the piston in final state;

FIG. 7 illustrates a well tool assembly comprising a plugging and abandonment tool, the downhole equalizing tool and a control and logging system.

Figure 1:
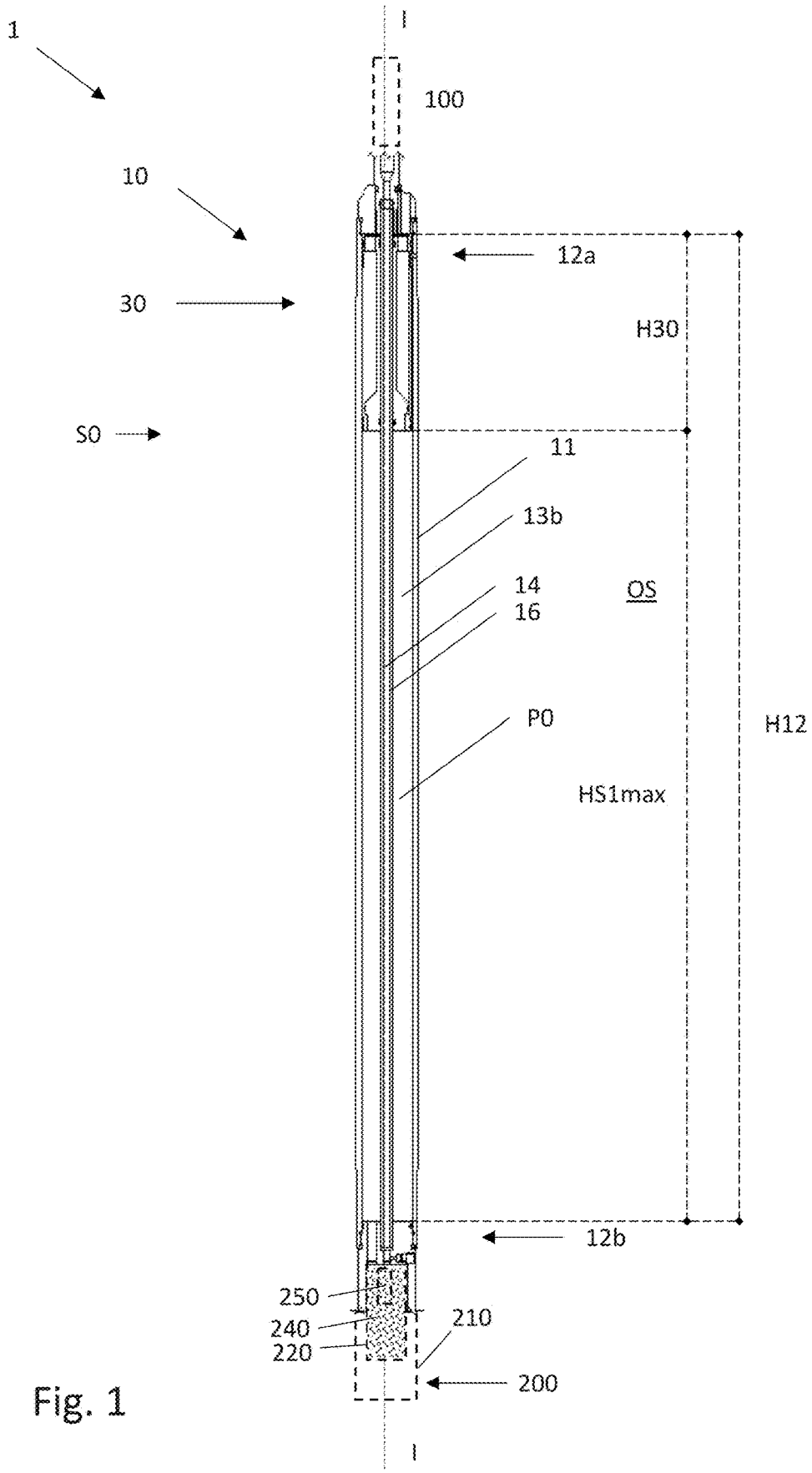
FIG. 1 illustrates a cross sectional side view of the equalizing tool in the initial state, where the piston device is in the first end of the piston compartment.

Initially, it is referred to FIG. 1. Here it is shown a well tool assembly 1 comprising three main parts, an upper control and logging system indicated as a dashed rectangle 100, a lower plugging and abandonment tool indicated as a dashed rectangle 200 and a downhole pressure equalizer 10 connected between the upper control and logging system 100 and the lower plugging and abandonment tool 200. A central longitudinal axis I-I is indicated in FIG. 1.

The upper control and logging system 100 typically comprises a wireline interface for connection to a wireline, and a housing in which sensors and control circuitry are provided.

The lower plugging and abandonment tool 200 may be of the type described in WO2013/135583, i.e. comprising a housing 210, a chamber 220 within the housing 210, and a heat generating mixture 240 and an igniter 250 located within the chamber 220.

First, the downhole pressure equalizer 10, in short referred to as the equalizer 10 will be described in detail. The equalizer 10 comprises an elongated housing 11 in which a piston compartment 12 is provided. The piston compartment 12 has a first or upper end 12*a* provided in fluid communication with an outside OS of the elongated housing 11 and a second end 12*b* provided in fluid communication with the chamber 220 of the well tool 200.

The housing 11 comprises a longitudinal rod 16 provided centrally through the piston compartment 12 and secured at both ends to the housing 11. A longitudinal communication bore 14 is provided within the rod 16. The purpose of the bore 14 is to enable that a sensor located adjacent to the first end 12*a* of the housing 11, typically a sensor located in the control and logging system 100, can measure the pressure in the second end 12*b* of the housing 11, typically the pressure in the chamber 220.

The relatively long communication bore 14 prevents or at least considerably delays the heat from the heat generation process to damage the pressure sensor.

The equalizer 10 further comprises a piston device 30 slidingly and sealingly engaged within the piston compartment 12. The piston device 30 is separating the piston compartment 12 into a first sub-compartment 13*a* between the piston device 30 and the first end 12*a* of the housing 11 and a second compartment 13*b* between the piston device 30 and the second end 12*b* of the housing 11.

Figure 4:
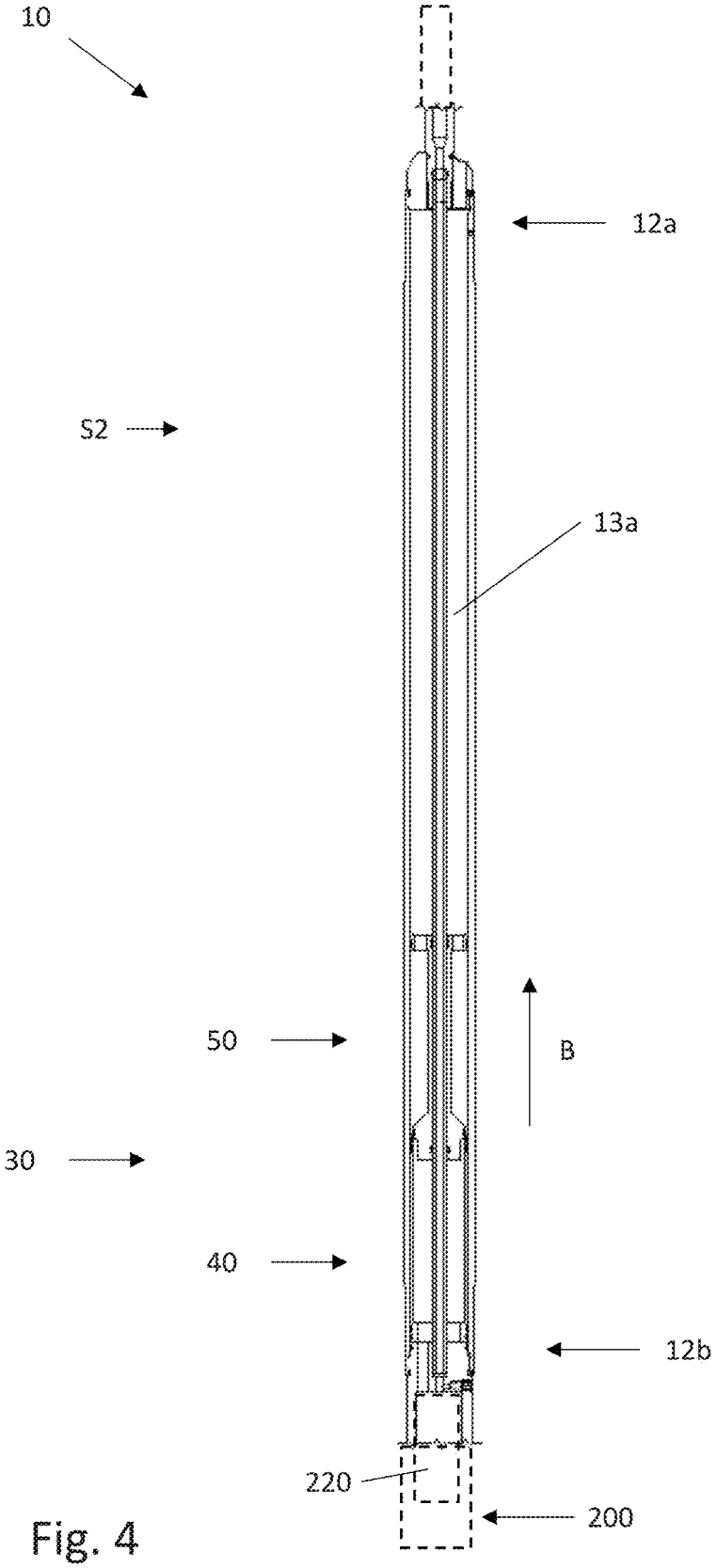
FIG. 4 illustrates a cross sectional side view of the equalizing tool in a second state, where the inner piston section is moving relative to the outer piston section.

It is now referred to FIG. 4, FIG. 6*a* and FIG. 6*b*. Here it is shown that the piston device 30 comprises an outer piston section 40 and an inner piston section 50.

The Outer Piston Section 40

The outer piston section 40 is slidingly and sealingly engaged with the piston compartment 12 and slidingly and sealingly engaged with the outer surface of the rod 16. The outer piston section 40 comprises a sleeve 41 in which a through bore 42. Hence, the outer piston section 40 alone does not separate the piston compartment 12 into the two sub-compartments 13*a*, 13*b*. The sleeve 41 further comprises a stop 43*b* in the form of an inwardly protruding restriction of the diameter of the bore 42. The upper end of the sleeve 41 is also forming a stop indicated as 43*a*.

The inwardly protruding restriction forming the stop 43*b* comprises a bore 46, allowing fluid from the second compartment 13*b* to enter the lower part of the bore 42.

Reference number 64*a* is a securing mechanism comprising a transportation element for securing the outer piston section 40 to the housing 11.

As shown in FIG. 6*b*, there is lower sealing element 64*b* radially outside of the outer piston section 40, to prevent fluid longitudinal fluid flow radially outside of the outer piston section 40, i.e. between the outer piston section 40 and the inner surface of the piston compartment 12.

The Inner Piston Section 50

The inner piston section 50 is slidingly and sealingly engaged within the through bore 42 of the outer piston section 40 and is also slidingly and sealingly engaged with the outer surface of the rod 16.

The inner piston section 50 comprises a first or upper end section 53*a*, a second or lower end section 53*b* and an intermediate section 53*c* longitudinally between the first end section 53*a* and the second end section 53*b*. A first surface 54*a* of the second end section 53*b* is faced towards the first piston compartment 13*a* and a second surface 54*b* of the second end section 53*b* is faced towards the second piston compartment 13*b*.

The second end section 53*b* is sealingly engaged with the bore 42 of the outer piston section 40 by means of a sealing element 65*b*. The second end section 53*b* has a larger outer diameter than the inner diameter of the inwardly protruding restriction of the diameter of the bore 42. Hence, the second end section 53*b* may be engaged with the stop 43*b* and prevent further downward movement of the inner piston section 50 relative to the outer piston section 40.

In addition, the first end section 53*a* of the inner piston section 50 is protruding upwardly from the bore 42 and comprises a collar 55 extending radially into contact with the piston compartment 12. Hence, the first end section 53*a* is slidingly engaged with the piston compartment 12.

A sliding element 65*a* is provided radially outside of the collar 55, to reduce friction between the collar 55 and the inner surface of the piston compartment 12.

The collar 55 comprises bores 56 for allowing fluid to flow from the first compartment 13*a* into the upper part of the bore 42.

The intermediate section 53*c* comprises a sleeve surrounding the rod 16.

In FIG. 6*b*, it is further shown that there is a sliding element 66*a* between the first end section 53*a* and the rod 16 and further that there is a sealing element 66*b* between the second end section 53*b* and the rod 16.

It should be noted that the housing 11, the outer piston section 40 and the inner piston section 50 are preferably made of aluminium.

Operation of the Equalizer 10

The operation of the equalizer will now be described in detail.

In FIG. 1, the equalizer 10 is in an initial state S0, wherein the piston 30 is stationary with respect to piston compartment 12. The outer piston section 40 and the inner piston section 50 are both located in the first end 12*a* of the piston compartment 12. The second piston compartment 13*b*, and hence the chamber 220, is pressurized with a predetermined fluid pressure P0.

The predetermined fluid pressure P0 is typically determined based on the expected well pressure at the well depth at which the downhole pressure equalizer 10 and the well tool 200 is to be used. Hence, the predetermined fluid pressure P0 is larger than the atmospheric pressure at sea level. It should be noted that this will not cause the inner piston section 50 to move relative to the outer piston section 40 as such movement is prevented by the first end 12*a* of the piston compartment 12.

The equalizer 10 will typically be in this initial state S0 when handled topside and during the initial lowering of the equalizer into the well. The transportation element 64*a* locking the piston 30 to the housing 11 in the position shown in FIG. 1, thereby preventing relative movement between the outer piston section 40 and the housing 11 and relative movement between the inner piston section 50 and the inner piston section 50, is removed topside before the operation starts.

Figure 2:
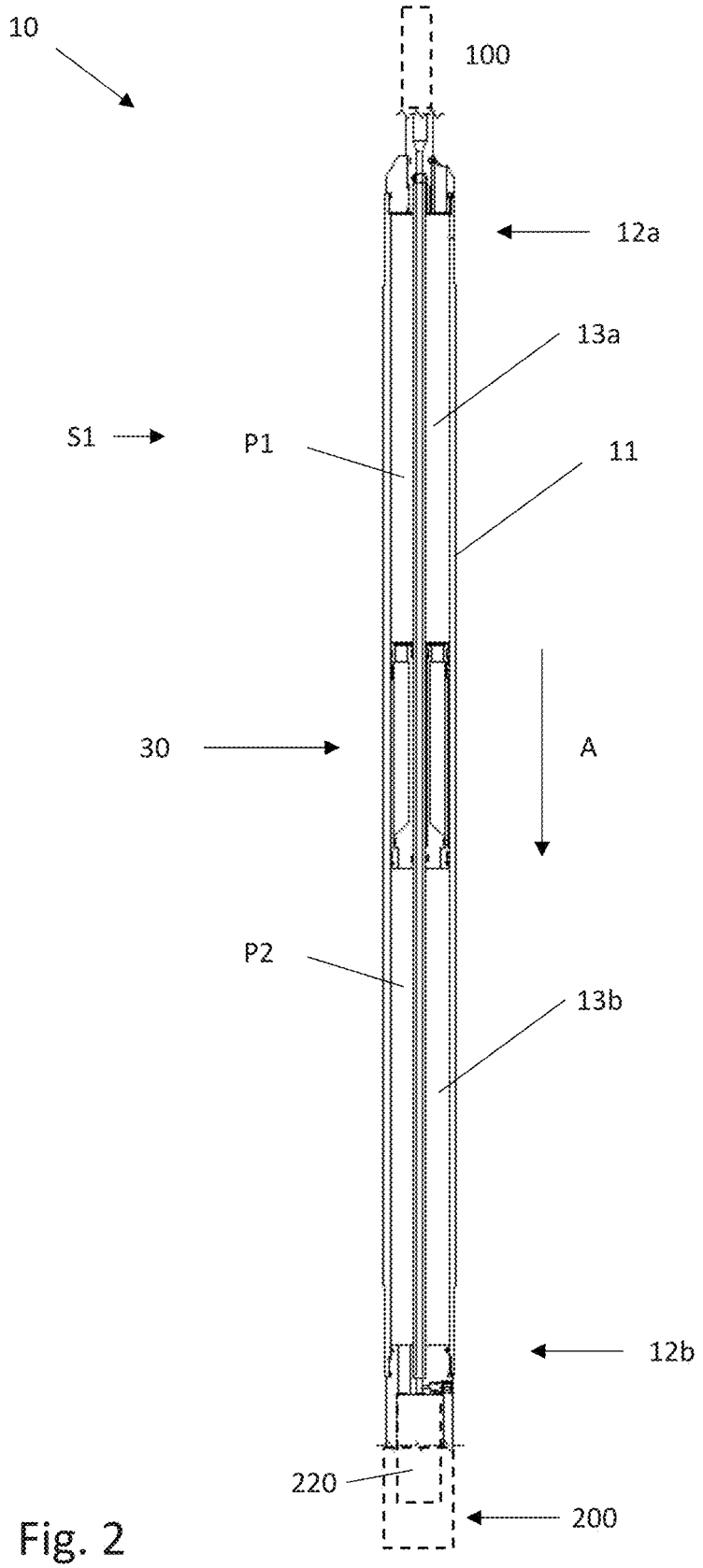
FIG. 2 illustrates a cross sectional side view of the equalizing tool in a first state, where the piston device is moving towards the middle of the piston compartment.

In FIG. 2 and FIG. 6*a*, the equalizer 10 is in a first state. The equalizer 10 will typically be in this first state during the lowering of the equalizer 10 into the well.

At some depth, the pressure on the outside OS of the equalizer 10 will increase to a point wherein the pressure difference between the fluid pressure P1 in the first sub-compartment 13*a* and the fluid pressure P2 in the second sub-compartment 13*b* will cause the outer piston section 40 and the inner piston section 50 to move towards the second end 12*b* of the piston compartment 12, as indicated by arrow A in FIG. 2. It is not possible for the inner piston section 50 to move downwardly relative to the outer piston section 40, as the stops 43*a*, 43*b* will prevent relative movement between the inner piston section 30 and the sleeve 41.

During the movement of the piston 30 in the direction A, the pressure in the second compartment 13*b* will be equalized with the pressure on the outside OS. It should be noted that the pressure in the second compartment 13*b* will not necessarily be identical to the pressure in the first compartment 13*a*, as it will require a pressure difference above a minimum threshold value before the piston 30 will start moving.

Figure 3:
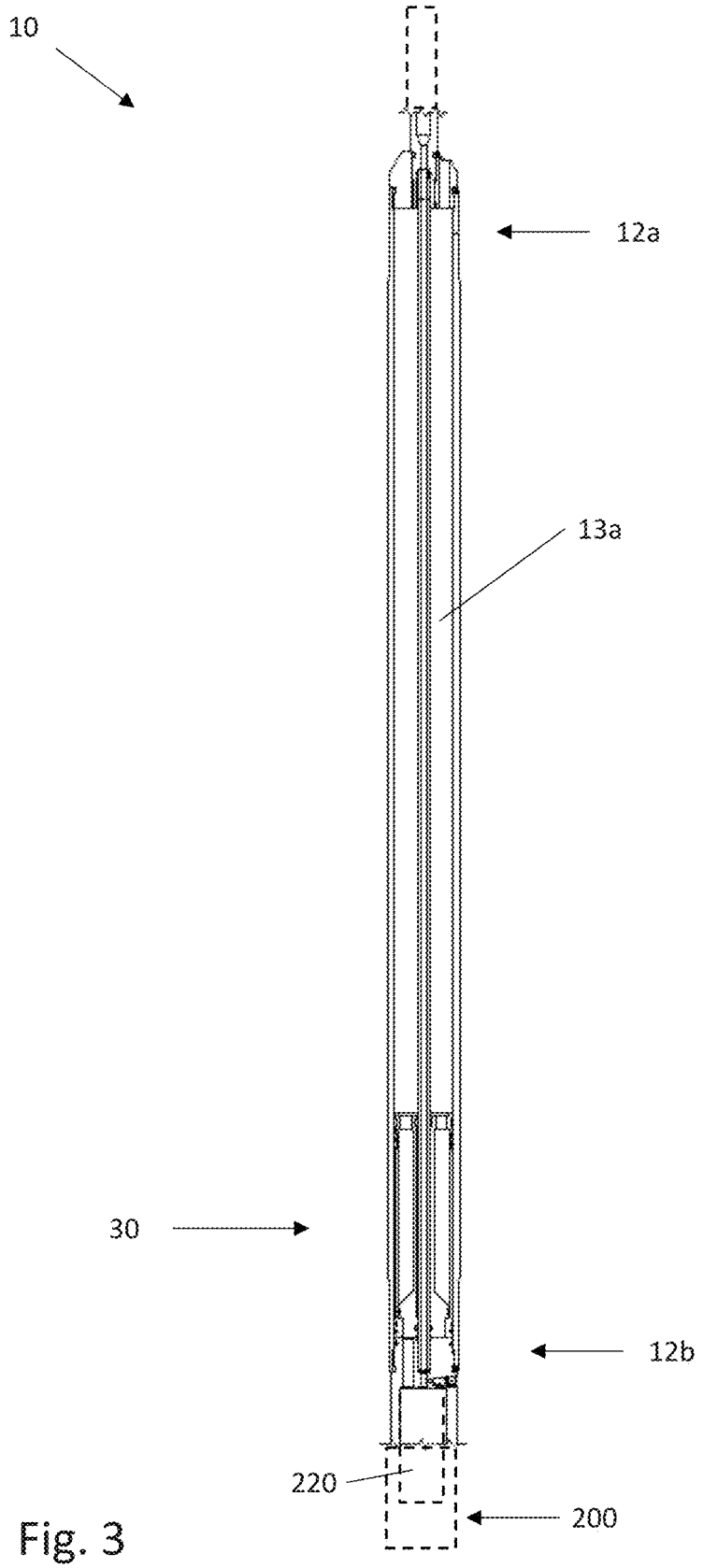
FIG. 3 illustrates a cross sectional side view of the equalizing tool after the first state, where the piston device has been moved to the second end of the piston compartment.

In FIG. 3, the piston 30 has moved to the second end 12*b* of the piston compartment 12. It should be noted that this is not a desired situation—as further pressure alignment is not possible. Consequently, a preferred situation is that when the equalizer 10 has reached the desired location in the well, the piston 30 has stopped at a location between the location shown in FIG. 2 and the location shown in FIG. 3. It should be noted that the expected location the piston after the first state S1 is calculated based on expected well pressure and temperature at the desired location in the well.

The heat generation process may now be started by igniting the heat generation mixture 240 in the chamber 220 by means of the igniter 250. The heat generation process will increase the pressure inside the chamber 220 and hence also the pressure P2 in the second sub-compartment 13*b*, while the pressure P1 in the first sub-compartment 13*a* will still be equal to the pressure on the outside OS. The equalizer 10 will soon be in its second state S2.

In FIG. 4, FIG. 5 and FIG. 6*b*, this second state S2 is shown. FIG. 4 shows the second state S2 when the first state S1 ended with the piston 30 having moved to the second end 12*b* of the piston compartment 12 (i.e. the position shown in FIG. 3), while FIG. 5 shows the second state S2 when the first state S1 ended with the piston 30 having moved to a position somewhere between the positions shown in FIG. 2 and the position shown in FIG. 3.

The pressure difference between the fluid pressure P1 in the first sub-compartment 13*a* and the fluid pressure P2 in the second sub-compartment 13*b* will now cause the inner piston section 50 to move towards the first end 12*a* of the piston compartment 12 as indicated by arrow B, while the outer piston section 40 is kept stationary relative to the housing 11.

During the movement of the inner piston section 50 in the direction B, the pressure in the second compartment 13*b* will be equalized with the pressure on the outside OS. It should be noted that the pressure in the second compartment 13*b* will not necessarily be identical to the pressure in the first compartment 13*a*, as it will require a pressure difference above a minimum threshold value before the inner piston section 50 will start moving.

It is now referred to FIG. 6*c*. Here, the inner piston section 50 is almost brought out from the sleeve 41 of the inner piston section 40. However, the inner piston section 50 is here still considered sealingly engaged with the sleeve 41.

It is now referred to FIG. 6*d*. Here, the inner piston section 50 has slid out of its sealing engagement within the bore 42 of the outer piston section 40. The equalizer is now in its final state S3. In the final state S3, the piston device 30 is no longer considered to be a piston, as there is a direct fluid communication between the first sub-compartment 13*a* and the second sub-compartment 13*b*.

It should be noted that additional measures may be taken to ensure that only the inner piston section 50 moves when the equalizer 10 is in the second state S2. This can be done by selecting the number of sealing and/or sliding elements or by selecting properties of the respective sealing and/or sliding elements so that a first friction parameter FP1, representing a friction for moving the outer piston section 40 relative to the housing 11, is larger than a second friction parameter FP2 representing a friction for moving the inner piston section 50 relative to the outer piston section 40.

It should further be noted that the pressure development of the heat generation process may develop fast, in some cases the second state S2 will have a duration of a few second, in some cases less than a second.

However, this is considered acceptable, as the heat generation process will also melt the housing 210 and therefore also result in a pressure equalization between the chamber 200 and the outside OS of the housing.

The inner piston section 50 will dampen a substantial part of the first pressure peak resulting from the start of the heat generation process. Hence, the risk of an explosion of the housing 210 will be considerably reduced.

The above operation may be at least partially be controlled by the control and logging system 100, which can be configured to verify that the first pressure P1 is equalized with the second pressure P2 when the well tool assembly 1 has been lowered to the desired location in the well and before the heat generation mixture is activated by the igniter 250. The control and logging system 100 may further be configured to verify that the first pressure P1 is equalized with the second pressure P2 during the heat generation process or after the heat generation process has finished.

The length of the housing 11 of the equalizer 10 may be determined by the expected travel distance for the piston 30 in the first state S1. However, the length of the housing 11 may also be considerably longer than this expected travel length, as the length of the housing 11 is also protecting the sensors etc. in the control and logging system 100 from the heat generation process of plugging and abandonment tool 200. The length of the outer piston section 40 and the inner piston section 50 may be determined by the expected travel distance for the inner piston section 50 relative to the outer piston section 40.

However, it is not necessarily cost efficient to tailor-make the equalizer for each operation—a standardized size for many operations may be preferred.

It is now referred to FIG. 1. Here, a height H12 of the piston compartment 12 is 1581 mm and a height H30 of the piston device 30 is 315 mm. The maximum movement HS1max of the piston device 30 in the first state S1 is therefore equal to the difference between H12 and H30, i.e. 1266 mm.

It is now referred to FIG. 6*c*. Here, the maximum movement HS2max of the inner piston section 50 relative to the outer piston section 40 in the second state S2 is 248 mm. When the inner piston section has moved the maximum movement HS2max, the equalizer 10 will be in its final state S3, in which the inner piston section 50 has slid out of its sealing engagement with the through bore 42 of the outer piston section 40.

Alternative Embodiments

It should be noted that a wireline may be secured to the upper end of the equalizer 10, i.e. the well tool assembly 1 only comprises the equalizer 10 and the lower plugging and abandonment tool 200. It should further be noted that the equalizer 10 may be used together with other well tools.

The invention claimed is:

1. A downhole pressure equalizer comprising:

an elongated housing comprising a piston compartment having a first end provided in fluid communication with an outside of the elongated housing and a second end provided in fluid communication with a process chamber of a well tool;

a piston device slidingly and sealingly engaged within the piston compartment, wherein the piston device separates the piston compartment into a first sub-compartment between the piston device and the first end and a second compartment between the piston device and the second end;

wherein the piston device comprises:

an outer piston section slidingly and sealingly engaged with the piston compartment, wherein the outer piston section comprises a sleeve having a through bore; and an inner piston section slidingly and sealingly engaged within the through bore of the outer piston section, wherein the downhole pressure equalizer is configured to be in one of:

a first state, in which a pressure difference between a fluid pressure in the first sub-compartment and a fluid pressure in the second sub-compartment causes the outer piston section and the inner piston section to move towards the second end of the piston compartment; and a second state, in which the pressure difference between the fluid pressure in the first sub-compartment and the fluid pressure in the second sub-compartment causes the inner piston section to move towards the first end of the piston compartment while the outer piston section is kept stationary.

2. The downhole pressure equalizer according to claim 1, wherein the downhole pressure equalizer is configured to be in an initial state before being in the one of the first state and the second state, wherein in the initial state, the outer piston section and the inner piston section are located in the first end of the piston compartment, and the second piston compartment is pressurized with a predetermined fluid pressure.

3. The downhole pressure equalizer according to claim 1, wherein the downhole pressure equalizer is configured to be in a final state after being in the one of the first state and the second state, wherein in the final state, the inner piston section has slid out of its sealing engagement with the through bore of the outer piston section.

4. The downhole pressure equalizer according to claim 1, further comprising a longitudinal communication bore for sensing the fluid pressure in the second sub-compartment at a location adjacent to the first end of the piston compartment.

5. The downhole pressure equalizer according to claim 1, further comprising a longitudinal rod provided through the piston compartment and secured at both ends to the elongated housing, wherein the outer piston section is slidingly and sealingly engaged with an outer surface of the longitudinal rod, and wherein the inner piston section is slidingly and sealingly engaged with the outer surface of the longitudinal rod.

6. The downhole pressure equalizer according to claim 5, wherein the longitudinal communication bore is provided within the longitudinal rod.

7. The downhole pressure equalizer according to claim 1, wherein a first friction parameter representing a friction for moving the outer piston section relative to the elongated housing is larger than a second friction parameter representing a friction for moving the inner piston section relative to the outer piston section.

8. The downhole pressure equalizer according to claim 7, wherein the first friction parameter and the second friction parameter are defined by the number of, or properties of, sealing elements sealingly engaged between the piston device and the piston compartment and between the inner piston section and the outer piston section.

9. The downhole pressure equalizer according to claim 1, wherein the outer piston section comprises a sleeve in which the through bore is provided, wherein the sleeve comprises a stop preventing relative movement between the inner piston section and the sleeve when the downhole pressure equalizer is in the first state.

10. The downhole pressure equalizer according to claim 1, wherein the inner piston section comprises a first end section, a second end section and an intermediate section, wherein the second end section is sealingly engaged within the through bore of the outer piston section, wherein a first surface of the second end section is faced towards the first piston compartment, and wherein a second surface of the second end section is faced towards the second piston compartment.

11. The downhole pressure equalizer according to claim 10, wherein the first end section of the inner piston section comprises a collar protruding from the through bore, wherein the collar is slidingly engaged with the piston compartment.

12. A well tool assembly for forming a permanent barrier in a well, wherein the well tool assembly comprises:

a plugging and abandonment tool comprising a housing, a chamber within the housing, and a heat generating mixture and an igniter located within the chamber; and the downhole pressure equalizer according to claim 1 connected above the plugging and abandonment tool, wherein the second sub-compartment is provided in fluid communication with the chamber of the plugging and abandonment tool.

13. Well The well tool assembly according to claim 12, further comprising:

a control and logging system connected above the downhole pressure equalizer, wherein the control and logging system comprises:

a first pressure sensor for logging a parameter representative of a first pressure in the first sub-compartment; and a second pressure sensor for logging a parameter representative of a second pressure in the second sub-compartment, wherein the control and logging system is configured to verify that the first pressure is equalized with the second pressure when the well tool assembly has been lowered to a desired location in the well and before the heat generation mixture is ignited by the igniter.

14. The well tool assembly according to claim 13, wherein the control and logging system is configured to verify that the first pressure is equalized with the second pressure during a heat generation process or after the heat generation process has finished.

* * * * *